US010518542B2

(12) United States Patent
Ochiai et al.

(10) Patent No.: US 10,518,542 B2
(45) Date of Patent: Dec. 31, 2019

(54) LIQUID EJECTING APPARATUS

(71) Applicant: SEIKO EPSON CORPORATION, Tokyo (JP)

(72) Inventors: Toshiyuki Ochiai, Shiojiri (JP); Tsutomu Kobayashi, Matsumoto (JP); Takeshi Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/032,337

(22) Filed: Jul. 11, 2018

(65) Prior Publication Data

US 2019/0016143 A1 Jan. 17, 2019

(30) Foreign Application Priority Data

Jul. 13, 2017 (JP) ..... 2017-137076

(51) Int. Cl.
*B41J 2/17* (2006.01)
*B41J 2/165* (2006.01)
*B41J 29/17* (2006.01)

(52) U.S. Cl.
CPC ..... *B41J 2/1721* (2013.01); *B41J 2/16508* (2013.01); *B41J 29/17* (2013.01); *B41J 2002/1742* (2013.01)

(58) Field of Classification Search
CPC ..... B41J 2/1721; B41J 2002/1742; B41J 2/16523; B41J 2002/1728
USPC ..... 347/22, 36
See application file for complete search history.

(56) References Cited

U.S. PATENT DOCUMENTS 8,602,522 B2 * 12/2013 Harada ..... B41J 2/1721 347/36
2012/0234436 A1 9/2012 Harada et al.
2012/0236074 A1 9/2012 Harada et al.

FOREIGN PATENT DOCUMENTS

JP 2012-196803 10/2012
JP 2014-240202 A 12/2014

* cited by examiner

*Primary Examiner* — An H Do
(74) *Attorney, Agent, or Firm* — Workman Nydegger

(57) ABSTRACT

A liquid ejecting apparatus includes a liquid ejecting head which ejects a liquid, a discharge portion which discharges a waste liquid discharged from the liquid ejecting head, and a mounting unit which is provided with the discharge portion and in which is mounted a waste liquid container capable of storing the waste liquid which is discharged from the discharge portion, in which the mounting unit includes a liquid holding portion capable of holding the waste liquid in a periphery of the discharge portion.

13 Claims, 8 Drawing Sheets

LIQUID EJECTING APPARATUS

BACKGROUND

1. Technical Field

The present invention relates to a liquid ejecting apparatus in which a waste liquid container is mounted to be attachable and detachable.

2. Related Art

A liquid ejecting apparatus which includes a mounting unit to which a waste liquid container for storing a waste liquid discharged from a liquid ejecting head is mounted is an example of a liquid ejecting apparatus which performs printing by ejecting a liquid from a liquid ejecting head onto a medium. A discharge portion which discharges the waste liquid discharged from the liquid ejecting head toward the waste liquid container is provided in the mounting unit of the liquid ejecting apparatus (for example, refer to JP-A-2012-196803).

However, the waste liquid discharged from the discharge portion of the mounting unit in the liquid ejecting apparatus may not be discharged toward the waste liquid container and may dribble from around the discharge portion and dirty the inside of the apparatus. For example, the possibility of such dirtying is high in a case in which the liquid ejecting apparatus is inverted.

SUMMARY

An advantage of some aspects of the invention is to provide a liquid ejecting apparatus capable of suppressing a waste liquid discharged from a discharge portion dribbling from around the discharge portion and dirtying an inside of the apparatus.

According to an aspect of the invention, there is provided a liquid ejecting apparatus which includes a liquid ejecting head which ejects a liquid, a discharge portion which discharges a waste liquid discharged from the liquid ejecting head, and a mounting unit which is provided with the discharge portion and in which a waste liquid container capable of storing the waste liquid discharged from the discharge portion is mounted, in which the mounting unit includes a liquid holding portion capable of holding the waste liquid in a periphery of the discharge portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
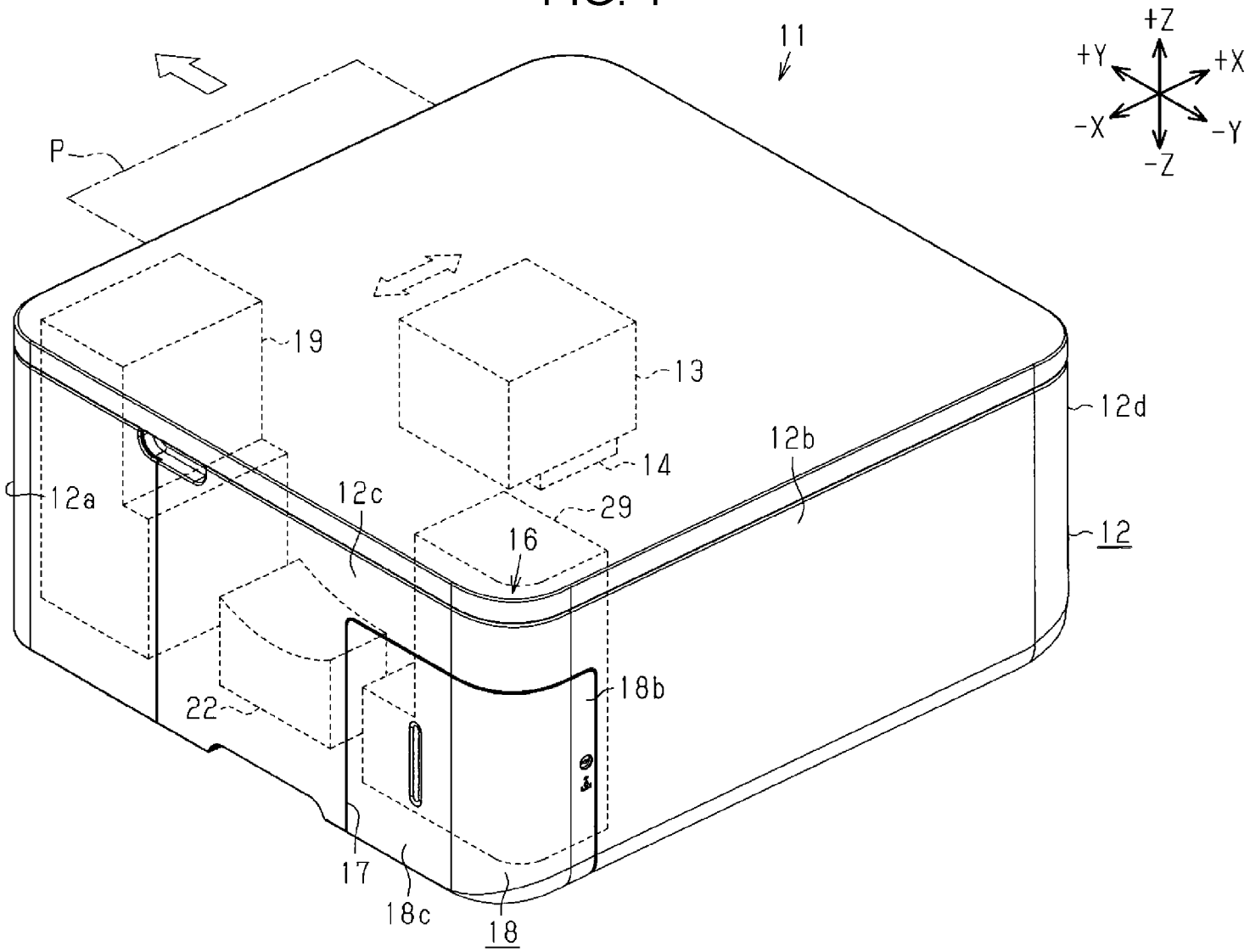
FIG. 1 is a perspective view illustrating the external appearance of a liquid ejecting apparatus.

Hereinafter, a description will be given of an embodiment of a liquid ejecting apparatus which is provided with a mounting unit to which it is possible to attach and detach a waste liquid container, with reference to the drawings. The liquid ejecting apparatus in the embodiment is configured by an ink jet printer which performs printing by ejecting an ink which is an example of a liquid onto paper which is an example of a medium. The printer is a so-called serial type printer of a printing type which causes a liquid ejecting head to move in a main scanning direction which intersects a transport direction of the paper to perform the printing.

The X-Y-Z coordinate system illustrated in the drawings is as follows. In other words, an X-direction is a movement direction (the main scanning direction) of a carriage (a moving body) on which the liquid ejecting head is mounted and which moves and matches a width direction of the liquid ejecting apparatus. A Y-direction is a depth direction of the liquid ejecting apparatus and matches the transport direction and the discharging direction of the paper. A Z-direction is a vertical direction and matches a height direction of the liquid ejecting apparatus.

With regard to the Z-direction, a vertically upward direction which is the top side of the apparatus is a +Z-direction and a vertically downward direction which is the bottom side of the apparatus is a −Z-direction. With regard to the Y-direction, as illustrated by the white filled arrow depicted with a solid line in FIG. 1, the direction in which the paper is discharged from inside the apparatus is a +Y-direction and the opposite direction is a −Y-direction. The X-direction is the left-right direction of a case in which the apparatus is viewed from the +Y-direction side, a direction which is the right side of the apparatus is a −X-direction, and a direction which is the left side of the apparatus is a +X-direction.

As illustrated in FIG. 1, a liquid ejecting apparatus 11 includes a rectangular parallelepiped housing 12 which uses the X-direction, which is the width direction, as the longitudinal direction. A box-shaped carriage 13 is provided in the inner portion of the housing 12 to be capable of moving reciprocally above the transporting region in which a paper P is transported during the printing in the X-direction, which is the main scanning direction, as illustrated by the white filled arrow with the dashed line in FIG. 1. A liquid ejecting head 14 which is capable of ejecting an ink (a liquid) toward the paper P which is transported in the transporting region is mounted to the bottom portion of the carriage 13.

The housing 12 includes a +Y-direction side surface 12*a*, a −Y-direction side surface 12*b*, and a left-right pair of surfaces 12*c* and 12*d*. In plan view from above, the discharge port (not illustrated) of the paper P is formed in the surface 12*a*, the surface 12*b* serves as the rear surface on the opposite side of the surface 12*a* when the surface 12*a* is the front surface, and the pair of surfaces 12*c* and 12*d* configure the side surfaces which intersect the two surfaces 12*a* and 12*b*. In an intersecting portion 16 in which, in a case in which the housing 12 is viewed from the +Y-direction side which is the front side of the left-right pair of surfaces 12*c* and 12*d*, the surface 12*c* of the −X-direction side which serves as the right side surface intersects the surface 12*b* of the −Y-direction side which is the rear surface, an opening portion 17 which has a rectangular cutout shape in a case in which the intersecting portion 16 is viewed from the −Y-direction side and the −X-direction side. In other words, the opening portion 17 is provided to span the surface 12*b* of the −Y-direction side and the surface 12*c* of the −X-direction side which are, of the six surfaces which configure the outer surfaces of the housing 12 which is a rectangular parallelepiped, the two surfaces which form the intersecting portion 16 by extending in the Z-direction which is the vertical direction and intersecting each other.

A cover 18 is mounted on the opening portion 17 in an attachable and detachable manner. The cover 18 is capable of covering the opening portion 17 when mounted on the opening portion 17 and includes a surface 18*b* which runs along the surface 12*b* of the −Y-direction side of the housing 12 in a state of being mounted on the opening portion 17 and a surface 18*c* which runs along the surface 12*c* of the −X-direction side of the housing 12 in a state of being mounted on the opening portion 17 in the same manner. In other words, when the cover 18 is mounted on the opening portion 17, the two surfaces 18*b* and 18*c* which intersect each other form a portion of the two surfaces 12*b* and 12*c* which intersect each other at the intersecting portion 16 in the housing 12.

As illustrated in FIG. 1, a tank-shaped liquid container 19 which stores the ink to be supplied to the liquid ejecting head 14 is disposed at a position on the −X-direction side in the inner portion of the housing 12 which is a position closer to the +Y-direction side than the reciprocal movement region of the carriage 13. A flexible liquid supply tube 20 is drawn out from the liquid container 19 and the distal end which serves as the downstream end of the liquid supply tube 20 is connected to a tube connecting portion 21 which is provided on the top portion of the carriage 13. Although not illustrated, an ink supply path for supplying the ink from the tube connecting portion 21 to the liquid ejecting head 14 is provided inside the carriage 13. The liquid container 19 may be a cartridge, may be an ink bag, and may be an ink tank into which it is possible to pour the ink.

Figure 2:
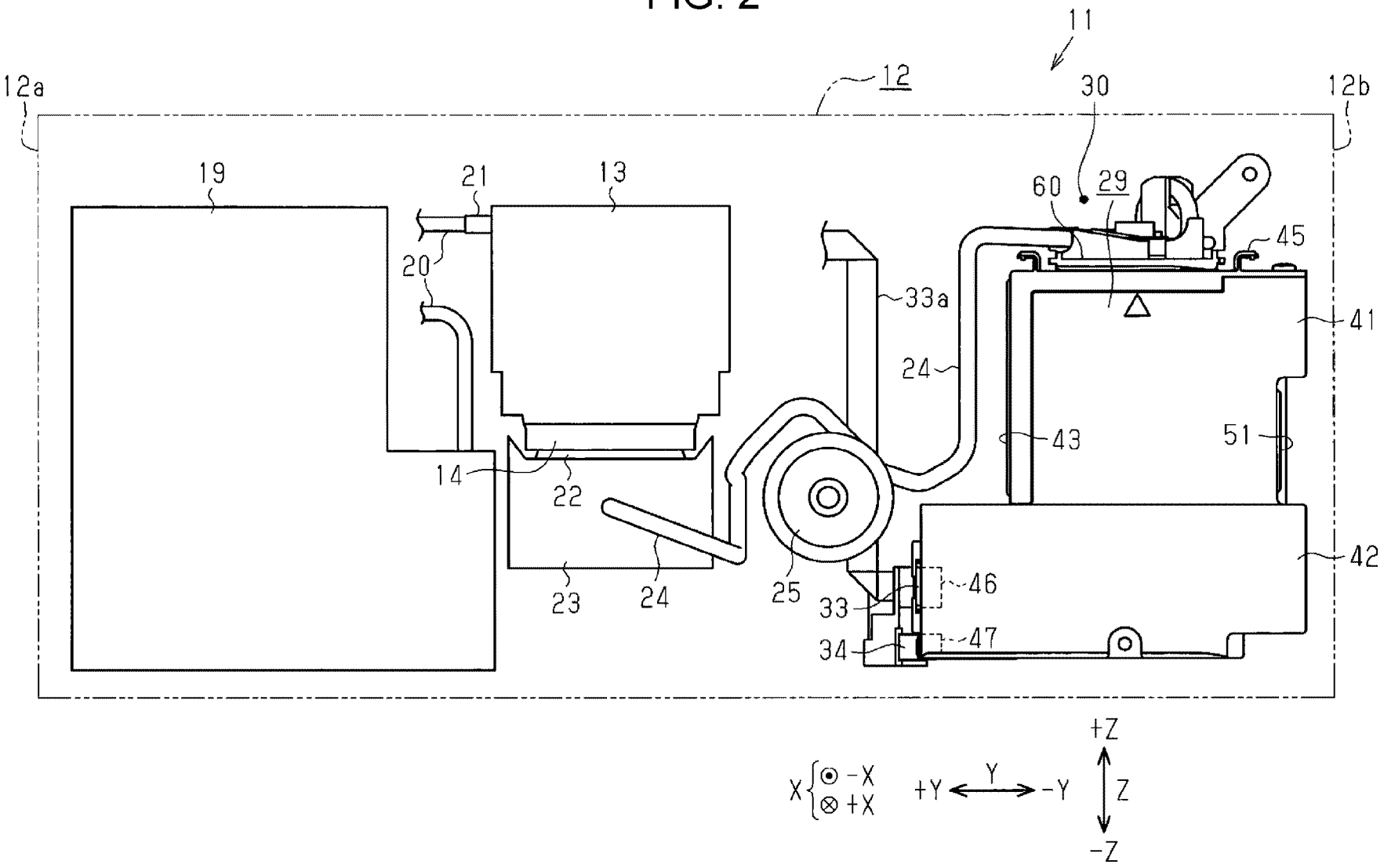
FIG. 2 is a side view schematically illustrating the internal structure of the liquid ejecting apparatus.

A maintenance portion 22 capable of maintaining the liquid ejecting head 14 is provided in the inner portion of the housing 12 at a position directly below the liquid ejecting head 14 when the carriage 13 to which the liquid ejecting head 14 is mounted moves to a position distanced from above the transporting region of the paper P to the −X-direction side. As illustrated in FIG. 1, the maintenance portion 22 is adjacent to the −Y-direction side of the liquid container 19 in the Y-direction which is the depth direction of the housing 12. As illustrated in FIG. 2, the maintenance portion 22 includes a cap 23, a flexible waste liquid tube 24, and a tube pump 25. The cap 23 receives the waste liquid which is not used in the printing and is discharged from the liquid ejecting head 14 as waste ink, the waste liquid tube 24 is drawn out from the cap 23 to be capable of guiding the waste liquid from inside the cap 23, the tube pump 25 is provided in the middle of the waste liquid tube 24 in the longitudinal direction, and the waste liquid from inside the cap 23 is sucked into the waste liquid tube 24 in accordance with the operation of the tube pump 25.

A waste liquid container 29 capable of storing the waste liquid is disposed in the inner portion of the housing 12 at a position which is closer to the −Y-direction side than the liquid container 19 in the Y-direction which is the depth direction of the housing 12 and which is adjacent to the maintenance portion 22 on the −Y-direction side. In other words, the liquid container 19, the maintenance portion 22, and the waste liquid container 29 are provided in the inner portion of the housing 12 at positions of the −X-direction side distanced from the transporting region of the paper P to the −X-direction side to line up in order from the front side to the depth side in the Y-direction which is the depth direction. The waste liquid which is sucked into the waste liquid tube 24 from inside the cap 23 is collected in the waste liquid container 29 in accordance with the operation of the tube pump 25.

Figure 3:
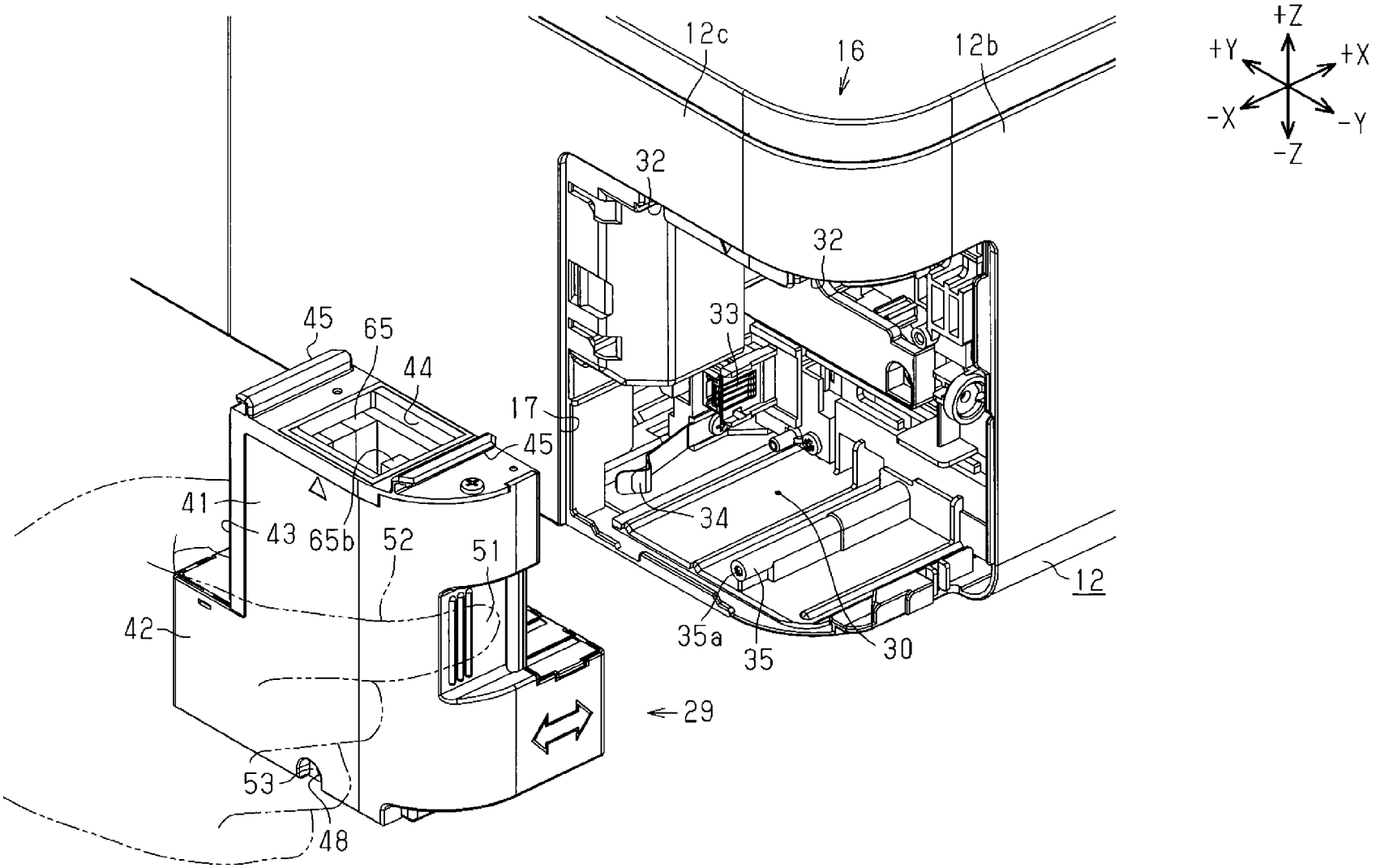
FIG. 3 is a partial perspective view of the liquid ejecting apparatus illustrating a state in which a waste liquid container is removed from a mounting unit.
Figure 4:
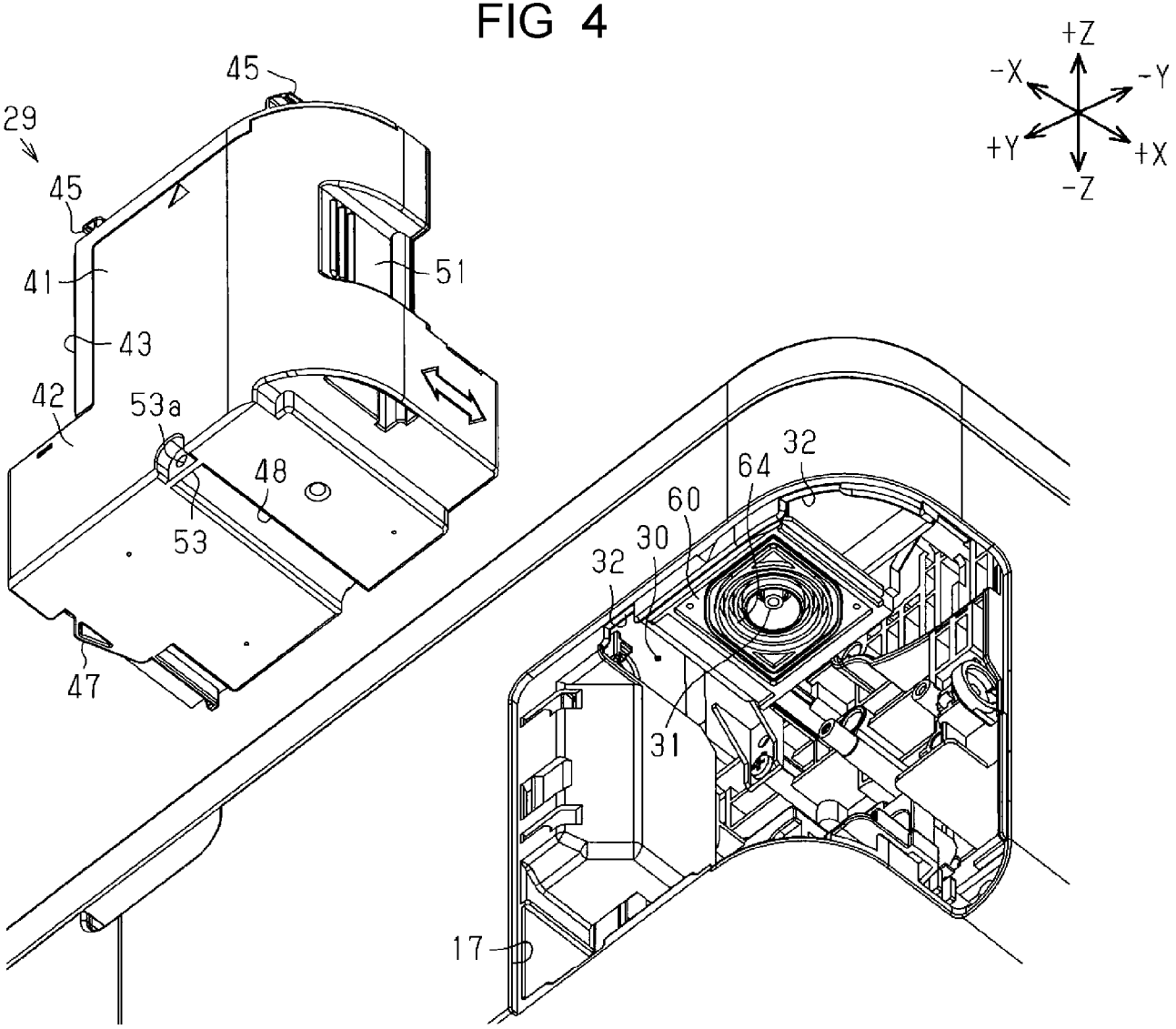
FIG. 4 is a partial perspective view of a case in which the state in FIG. 3 is viewed from below.

As illustrated in FIGS. 3 and 4, a mounting unit 30 into which the waste liquid container 29 is mounted on an attachable and detachable manner is provided on the inside of the opening portion 17 in the housing 12. The mounting unit 30 can be exposed to the outside of the housing 12 via the opening portion 17 and is hidden from the outside when the cover 18 is mounted on the opening portion 17. FIGS. 3 and 4 illustrate a state in which the cover 18 is removed from the opening portion 17. As illustrated in FIG. 4, a cylindrical discharge portion 31 which is capable of discharging the waste liquid toward the −Z-direction is provided in the top portion inside the mounting unit 30. An apparatus-side alignment portion 32 which can be used in the alignment when installing the waste liquid container 29 in the mounting unit 30 via the opening portion 17 from the outside of the housing 12 is formed on the top portion inside the mounting unit 30. In a case in which the mounting unit 30 is viewed from the X-direction which serves as the mounting direction of the waste liquid container 29 to the mounting unit 30, the apparatus-side alignment portion 32 is formed by cutting out to form recessed shapes in which the −Z-direction side is open at positions interposing the discharge portion 31 from both sides in the Y-direction.

As illustrated in FIG. 3, an apparatus-side terminal portion 33 which is configured to include an elastically deformable terminal fitting or the like is provided at a position which is on the +Y-direction side and on the +X-direction side on the bottom portion inside the mounting unit 30. The apparatus-side terminal portion 33 is positioned below the discharge portion 31 in the −Z-direction inside the mounting unit 30 and is electrically connected to a control portion (not illustrated) which is provided inside the housing 12 via a flexible flat cable 33*a* or the like. In a case in which the liquid ejecting apparatus 11 is viewed from the −X-direction, the liquid container 19 is positioned closer to the +Y-direction than the apparatus-side terminal portion 33 and the discharge portion 31 is positioned closer to the −Y-direction than the apparatus-side terminal portion 33. In other words, the apparatus-side terminal portion 33 is disposed between the liquid container 19 and the discharge portion 31 in the Y-direction which is the horizontal direction.

An apparatus-side engagement portion 34 is provided at a position at which the apparatus-side engagement portion 34 is adjacent to the apparatus-side terminal portion 33 on the bottom side in the Z-direction which is the vertical direction in the bottom portion inside the mounting unit 30. The apparatus-side engagement portion 34 is formed from a plate metal piece in which a portion on the +X-direction side which serves as a base end side extends in the X-direction and an end portion on the −X-direction side which serves as the distal end portion is mountain folded to the −Y-direction side. In other words, the apparatus-side engagement portion 34 is configured such that the portion on the −X-direction side which serves as the free end is elastically deformable in the Y direction. A cylindrical apparatus-side attachment portion 35 which has a female screw hole 35*a* in the distal end is provided at a position which serves as substantially the center of the mounting unit 30 closer to the −Y-direction side than the apparatus-side engagement portion 34 on the bottom portion inside the mounting unit 30 to extend in the X-direction.

As illustrated in FIGS. 2 to 4, the waste liquid container 29 is substantially rectangular in plan view from above and includes a waste liquid storage chamber 29*a* (refer to FIG. 5) capable of storing the waste liquid in the inner portion of the waste liquid container 29. The waste liquid container 29 includes a first storage portion 41 which is positioned on the +Z-direction side in the Z-direction and a second storage portion 42 which is positioned closer to the −Z-direction side than the first storage portion 41 and communicates the first storage portion 41 with the waste liquid storage chamber 29*a* of the inner portion. In the waste liquid container 29, a portion on the +Y-direction side and the +X-direction side which is closer to the +Z-direction side than the second storage portion 42 is a substantially L-shaped level difference portion 43 in plan view from above. Therefore, the second storage portion 42 is formed larger than the first storage portion 41 in plan view from above due to the presence of the level difference portion 43.

A waste liquid inlet portion 44 which is open toward the +Z-direction which is upward is formed in the top surface of the first storage portion 41 in the waste liquid container 29. The waste liquid inlet portion 44 communicates with the waste liquid storage chamber 29*a* of the inner portion of the waste liquid container 29, and in a state in which the waste liquid container 29 is mounted on the mounting unit 30, the position in the Z-direction of the waste liquid inlet portion 44 overlaps that of the discharge portion 31 which is positioned on the top portion inside the mounting unit 30, and is capable of introducing the waste liquid discharged from the discharge portion 31 to the waste liquid storage chamber 29*a*. In the waste liquid container 29, the waste liquid inlet portion 44 also functions as an atmosphere-open portion of the waste liquid storage chamber 29*a*. In other words, the waste liquid container 29 is disposed at a position at which the atmosphere-open portion from the waste liquid storage chamber 29*a* is close to the waste liquid inlet portion 44 with respect to the waste liquid storage chamber 29*a*. Therefore, since it is possible to reduce the resistance when introducing the waste liquid to the waste liquid storage chamber 29*a*, it is possible to smoothly discharge the waste liquid into the waste liquid container 29.

A pair of container-side alignment portions 45 which are aligned to and inserted into the pair of apparatus-side alignment portions 32 which are provided on the top portion inside the mounting unit 30 when the waste liquid container 29 is mounted on the mounting unit 30 is provided to extend in the X-direction on the top surface of the first storage portion 41 in the waste liquid container 29. When the waste liquid container 29 is mounted on the mounting unit 30, the X-direction is the mounting direction and the pair of container-side alignment portions 45 is formed in positions interposing the waste liquid inlet portion 44 from both sides in the Y-direction which intersects the X-direction which is the mounting direction.

As illustrated using a dashed line in FIG. 2, a container-side terminal portion 46 which is in contact with and is electrically connected to the apparatus-side terminal portion 33 inside the mounting unit 30 when the waste liquid container 29 is mounted on the mounting unit 30 is provided on the +Y-direction side surface which is one side surface of the second storage portion 42 in the waste liquid container 29. A container-side engagement portion 47 which engages with the apparatus-side engagement portion 34 when the waste liquid container 29 is mounted on the mounting unit 30 is provided at a position adjacent to the container-side terminal portion 46 on the bottom side in the Z-direction in the surface of the +Y-direction side of the second storage portion 42. In the container-side engagement portion 47, a portion of the +X-direction side which serves as the front side in the mounting direction of the waste liquid container 29 with respect to the mounting unit 30 is a guide surface which extends in the X-direction and a portion of the −X-direction side which serves as the rear side in the mounting direction is formed in a valley shape that inclines upward to the +Y-direction side and subsequently goes to the −Y-direction side. In other words, the container-side engagement portion 47 is configured to engage with the apparatus-side engagement portion 34 while restricting the movement in the X-direction together with the elastic deformation in the Y-direction of the distal end portion which is mountain folded to the −Y-direction side in the apparatus-side engagement portion 34.

A groove portion 48 which has a semicircular cross-sectional shape and into which it is possible to insert the apparatus-side attachment portion 35 when the waste liquid container 29 is mounted on the mounting unit 30 is formed to extend in the X-direction in the bottom surface of the second storage portion 42 in the waste liquid container 29. A recessed portion 51 which extends from the surface of the +X-direction side to the surface of the −X-direction side in the first storage portion 41 is formed in the surface of the −Y-direction side in the waste liquid container 29. Therefore, as illustrated in FIG. 3, when installing the waste liquid container 29 in the mounting unit 30, the user is easily capable of gripping the waste liquid container 29 by placing fingertips 52 on the recessed portion 51 and the level difference portion 43 in the waste liquid container 29. As illustrated in FIG. 4, a wall-shaped storage body-side attachment portion 53 which includes a through hole 53*a* is formed on the end portion on the −X-direction side which is the rear side in the mounting direction of the waste liquid container 29 with respect to the mounting unit 30 in the groove portion 48. In other words, in a state in which the cylindrical apparatus-side attachment portion 35 is inserted into the groove portion 48, the waste liquid container 29 is fixed to the mounting unit 30 by screwing a screw member (not illustrated) which is passed through the through hole 53*a* of the storage body-side attachment portion 53 into the female screw hole 35*a* of the distal end of the apparatus-side attachment portion 35.

Incidentally, when the liquid ejecting apparatus 11 is carried by the user in a case in which the mounting location is changed, for example, the liquid ejecting apparatus 11 may be inverted such that the longitudinal direction of the housing 12 assumes a posture parallel to the Z-direction which is the vertical direction. In such a case, there is a concern that the waste liquid will dribble from the discharge portion 31 due to the differential head and the inside of the apparatus will become dirty. Therefore, in the liquid ejecting apparatus 11 of the embodiment, in order to deal with such a case, the following characteristic configuration is present in the periphery of the discharge portion 31.

Figure 5:
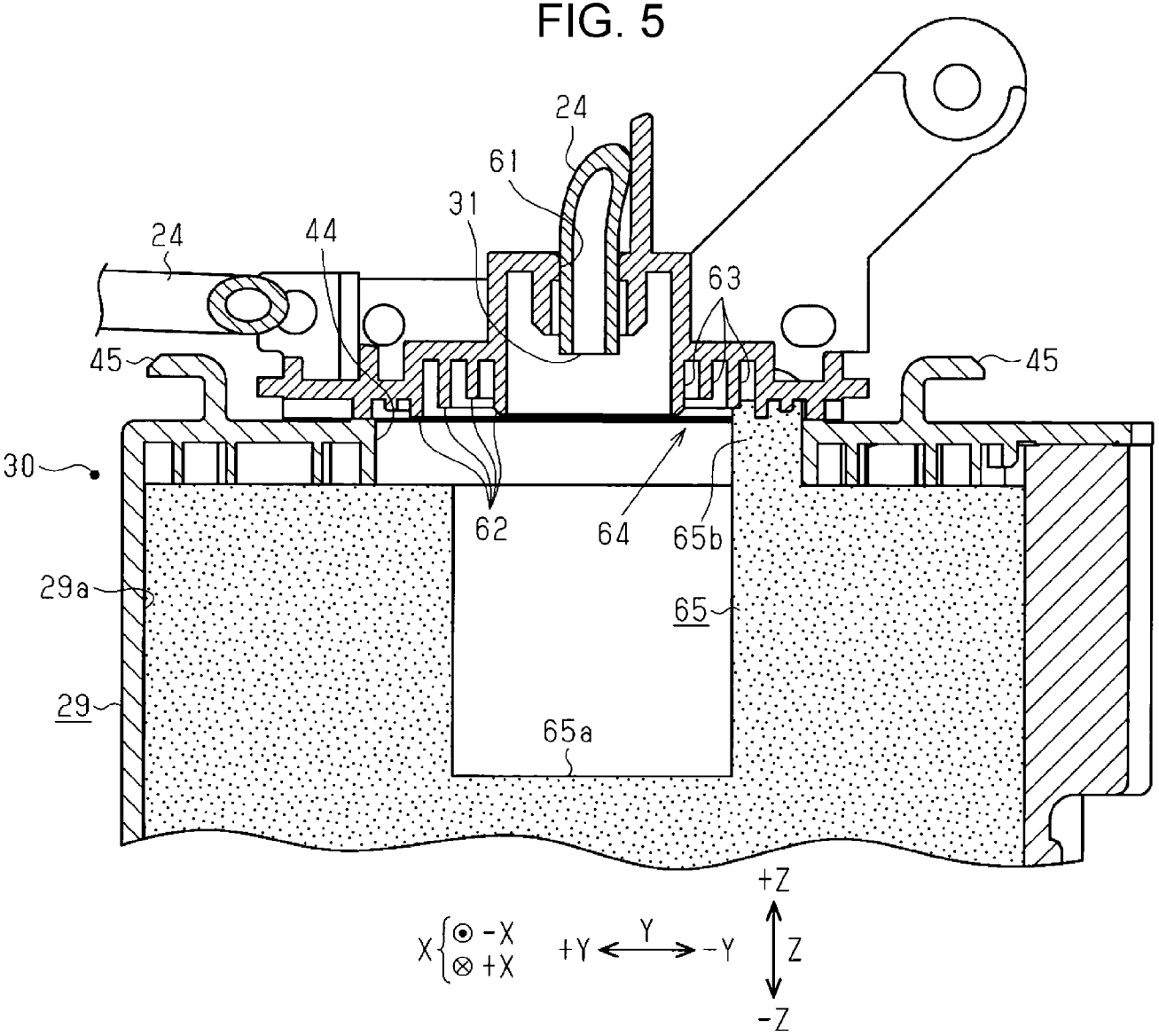
FIG. 5 is a partial sectional diagram illustrating a positional relationship between a discharge portion and the waste liquid container.

In other words, as illustrated in FIGS. 4 and 5, a support member 60 which has a rectangular shape in a case in which the support member 60 is viewed from the Z-direction is fixed to the top portion of the mounting unit 30 and a hole 61 which penetrates the support member 60 in the Z-direction is formed in approximately the center of the support member 60. In the embodiment, the discharge portion 31 which discharges the waste liquid toward the waste liquid inlet portion 44 of the waste liquid container 29 is configured by the downstream end of the waste liquid tube 24 which passes through the hole 61 so as to protrude from above to below.

A plurality of (for example, four) concentric circular ring-shaped convex portions 62 which are centered on the hole 61 are provided on the surface of the −Z-direction side which serves as the bottom surface of the support member 60 so as to protrude in the −Z-direction leaving a small interval in the radial direction. As illustrated in FIG. 5, the heights of each of the convex portions 62 are different in the Z-direction from the other convex portions 62 which are adjacent in a direction distancing from the discharge portion 31. In the embodiment, for example, the convex portion 62 which is innermost in the radial direction is the highest, the convex portion 62 which is adjacent thereto and is second from the inside is the lowest, and the convex portions 62 which are adjacent toward the outside are formed to be sequentially higher. A plurality of (for example, three) concentric circular ring-shaped recessed portions 63 which are also centered on the hole 61 are provided between the convex portions 62 which are adjacent in the radial direction. Since the recessed portions 63 are a plurality of concentric circular grooves having narrow groove widths and are capable of exhibiting the capillary phenomenon, in the embodiment, a liquid holding portion 64 which is capable of holding the waste liquid (the liquid) in the periphery of the discharge portion 31 is configured by the recessed portions 63 which form groove shapes.

As illustrated in FIGS. 3 and 5, a liquid absorbing material 65 which is formed from urethane or the like, for example, is stored inside the waste liquid container 29. The liquid absorbing material 65 is formed from a plurality of (for example, four) blocks made of urethane which have substantially the same external shape in a case in which the blocks are viewed from the X-direction and is stored inside the waste liquid storage chamber 29*a* in a state in which the blocks overlap in the X-direction. A depressed portion 65*a* which is depressed in the −Z-direction is formed in the liquid absorbing material 65 at a location which is directly below the discharge portion 31 when the waste liquid container 29 is mounted on the mounting unit 30. When the waste liquid is discharged from the discharge portion 31, the waste liquid is absorbed by the depressed portion 65*a* of the liquid absorbing material 65 and permeates toward the other locations inside the liquid absorbing material 65 from the depressed portion 65*a*.

Figure 6:
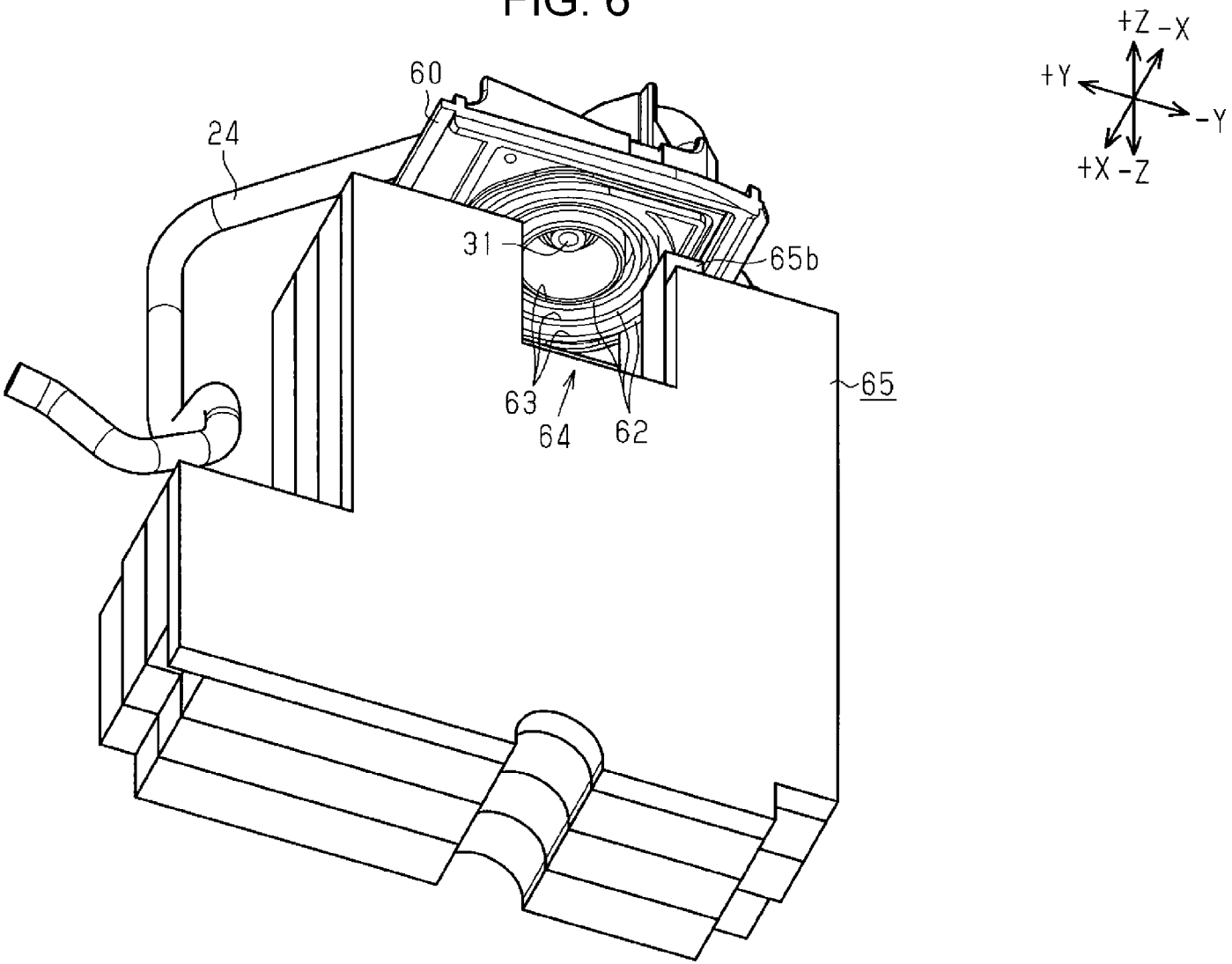
FIG. 6 is a perspective view of a case in which a state in which a liquid guiding portion is in contact with a liquid holding portion as viewed from below.

As illustrated in FIGS. 5 and 6, a portion of the top surface of the liquid absorbing material 65 protrudes in the +Z-direction which is upward from the waste liquid inlet portion 44 and the protruding portion configures a liquid guiding portion 65*b* which comes into contact with the liquid holding portion 64 of the periphery of the discharge portion 31 in a state in which the waste liquid container 29 is mounted on the mounting unit 30 and guides the waste liquid into the waste liquid container 29. In the case of the embodiment, the liquid guiding portion 65*b* is configured by a portion which protrudes in a columnar shape from, of the plurality of blocks which overlap each other in the X-direction and configure the liquid absorbing material 65, the top surface of one block which is interposed by the other blocks.

As illustrated in FIG. 2, the positional relationship between the liquid container 19, the liquid ejecting head 14, and the mounting unit 30 is such that, in the Y-direction which is the horizontal direction, the liquid container 19 is positioned on the +Y-direction side, the mounting unit 30 is positioned on the −Y-direction side, and the liquid ejecting head 14 is positioned between the liquid container 19 and the mounting unit 30. As illustrated in FIG. 5, when the waste liquid container 29 is mounted on the mounting unit 30, the liquid guiding portion 65*b* which protrudes from the waste liquid inlet portion 44 of the waste liquid container 29 comes into contact with the liquid holding portion 64 of the periphery of the discharge portion 31. However, in the contact position, in this case, is positioned further in the −Y-direction than the discharge portion 31 in the Y-direction. Therefore, the discharge portion 31 is positioned between the liquid container 19 and the liquid guiding portion 65*b* in the Y-direction which is the horizontal direction.

In the liquid ejecting apparatus 11 of the embodiment, a characteristic configuration for handling a case in which the liquid ejecting apparatus 11 is inverted is also present in the cap 23 of the maintenance portion 22. Hereinafter, a description will be given of the characteristic configuration of the cap 23 with reference to FIG. 7. The state of FIG. 7 illustrates a capping state in which the cap 23 abuts a nozzle opening surface 14*a* in which the nozzles (not illustrated) are opened in the liquid ejecting head 14.

Figure 7:
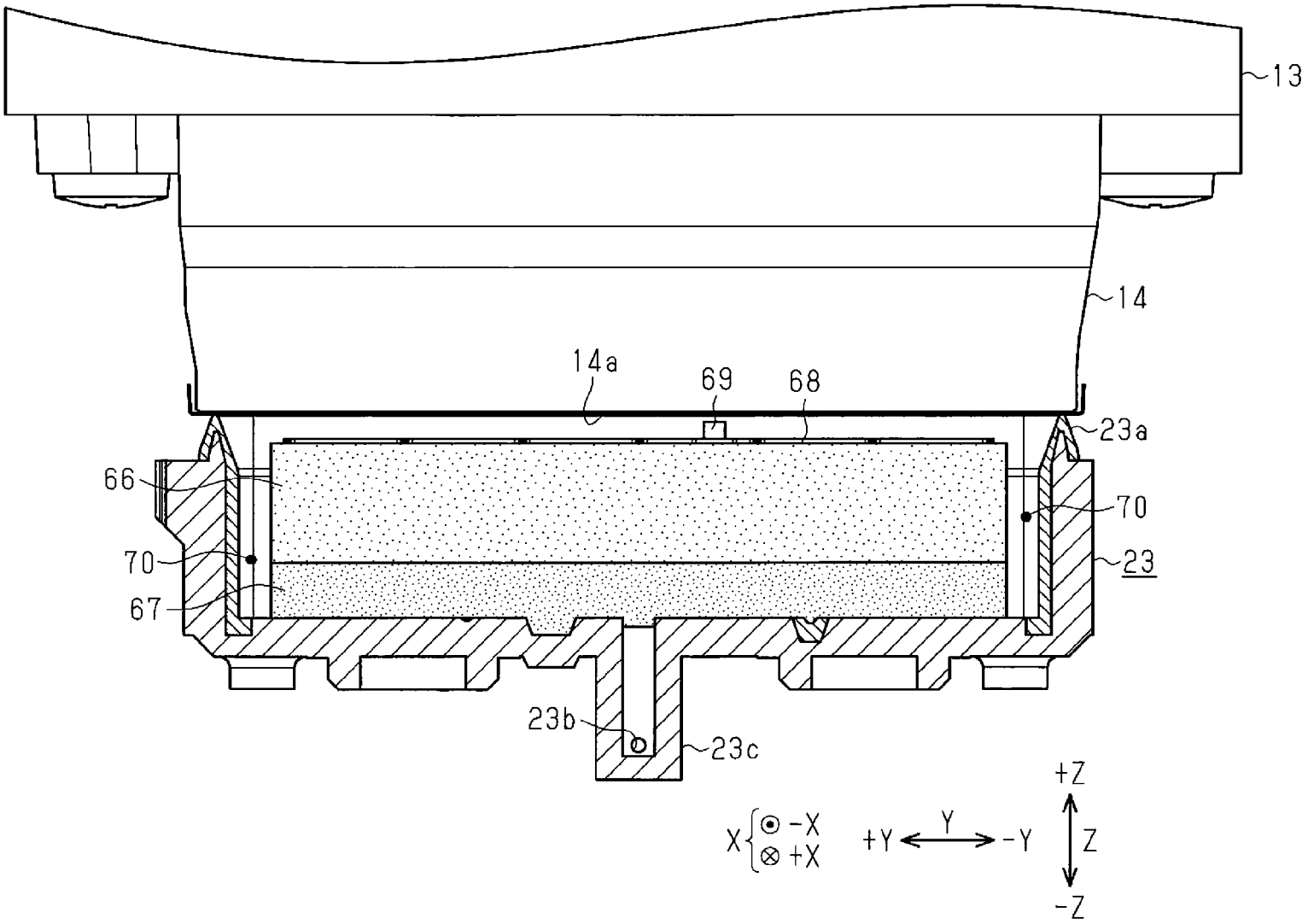
FIG. 7 is a partial sectional diagram illustrating a state in which a cap abuts a liquid ejecting head.

As illustrated in FIG. 7, the cap 23 has a bottomed box shape in which the side which faces the nozzle opening surface 14*a* of the liquid ejecting head 14 is open and includes, in the peripheral edge portion of the cap 23, a lip portion 23*a* which is formed from a flexible material such as an elastomer which is capable of sealing the nozzle opening surface 14*a* during the capping. A cylinder portion 23*c* which includes a discharge port 23*b* of the waste liquid is formed to protrude downward in the bottom portion of the cap 23 and the upstream end of the waste liquid tube 24 is connected to the cylinder portion 23*c*. A first liquid absorption mat 66 and a second liquid absorption mat 67 which are formed from urethane, for example, are disposed inside the cap 23 in an overlapping state such that the first liquid absorption mat 66 is on the top side. Since the first liquid absorption mat 66 of the top side is formed with a relatively low density, the liquid discharging properties thereof are excellent and since the second liquid absorption mat 67 of the bottom side is formed with a relatively high density, the liquid holding capability thereof is excellent. A mat retaining fitting 68 is disposed on the top surface of the first liquid absorption mat 66 and the mat retaining fitting 68 is fixed to a fixing portion 69 which is provided to stand up from the bottom portion of the cap 23.

The first liquid absorption mat 66 and the second liquid absorption mat 67 have substantially the same rectangular shape in a case in which the mats are viewed from above in plan view and are formed such that the length in the Y-direction is shorter than the interval between the inside surface on the −Y-direction side of the cap 23 and the inside surface on the +Y-direction side of the cap 23. Therefore, in a state in which the two liquid absorption mats 66 and 67 are disposed to overlap each other inside the cap 23, a gap 70 is formed in the Y direction between the inside surface of the cap 23 and the end surface of each of the liquid absorption mats 66 and 67. The gap 70 includes a function of breaking the connection between the ink (the liquid) which adheres to the inside surface of the cap 23 which formed the bottom surface of the cap 23 and the ink (the liquid) which is held by the liquid absorption mats 66 and 67 in a case in which the posture of the liquid ejecting apparatus 11 is inverted, for example. In other words, it is possible to suppress the ink (the liquid) which is held by the liquid absorption mats 66 and 67 from being retained on the inside surface side of the cap 23 which serves as the bottom surface of the cap 23. Accordingly, it is possible to suppress the ink (the liquid) which is held by the liquid absorption mats 66 and 67 from connecting with the ink (the liquid) inside the nozzles, flowing to the downstream side, and dirtying the inside of the apparatus by overflowing from the discharge portion 31.

Next, a description will be given of the operation of the liquid ejecting apparatus 11 which is configured in the manner described above, focusing on a case in which the waste liquid container 29 is mounted on the mounting unit 30 which is provided in the liquid ejecting apparatus 11.

When installing the waste liquid container 29 in the mounting unit 30 of the housing 12, first, the cover 18 is removed from the opening portion 17 of the housing 12. When the cover 18 is removed from the opening portion 17, in order to expose the mounting unit 30 inside the housing 12 to the outside, the waste liquid container 29 is mounted on the mounting unit 30 from the outside. At this time, since the container-side alignment portion 45 is aligned to the apparatus-side alignment portion 32, it is possible to install the waste liquid container 29 without causing misalignment between the waste liquid inlet portion 44 and the discharge portion 31. During the mounting, the liquid guiding portion 65*b* which protrudes from the waste liquid inlet portion 44 of the waste liquid container 29 comes into contact with the liquid holding portion 64 of the periphery of the discharge portion 31 and the container-side terminal portion 46 of the waste liquid container 29 is electrically connected to the apparatus-side terminal portion 33 of the mounting unit 30.

In the mounting state, the waste liquid discharged from the discharge portion 31 is introduced to the waste liquid storage chamber 29*a* of the waste liquid container 29 via the waste liquid inlet portion 44 and is stored in a state of being absorbed into the liquid absorbing material 65. In a case in which the waste liquid discharged from the discharge portion 31 adheres to the area around the discharge portion 31 without being discharged inside the waste liquid container 29, the waste liquid is held by the liquid holding portion 64 which is configured by the plurality of recessed portions 63 in the periphery of the discharge portion 31. At this time, since the heights of the convex portions 62 which are adjacent an interpose the recessed portions 63 therebetween are different, the waste liquid which is held by the liquid holding portion 64 is suppressed from traveling between the distal ends of the adjacent convex portions 62 and spreading in a direction which distances from the discharge portion 31. The waste liquid which is held by the liquid holding portion 64 is guided into the waste liquid container 29 via the liquid guiding portion 65*b* which is in contact with the liquid holding portion 64.

In a case in which the liquid ejecting apparatus 11 is inverted, that is, in a case in which the housing 12 is inverted to a posture in which the liquid container 19 is positioned higher than the liquid ejecting head 14 and the waste liquid container 29 is positioned lower than the liquid ejecting head 14, the liquid guiding portion 65*b* is positioned below the discharge portion 31. Therefore, even in a case in which the waste liquid dribbles from the discharge portion 31 due to the differential head during this posture, the waste liquid is held by the liquid holding portion 64 and is subsequently guided into the waste liquid container 29 via the liquid guiding portion 65*b*. In this posture, since the apparatus-side terminal portion 33 also positioned above the discharge portion 31, the waste liquid which dribbles from the discharge portion 31 due to the differential head is suppressed from getting into the apparatus-side terminal portion 33.

According to the embodiments described above, it is possible to obtain the following effects.

(1) In a case in which the waste liquid discharged from the discharge portion 31 of the mounting unit 30 adheres to the area around the discharge portion 31 without being discharged into the waste liquid container 29, the waste liquid is held by the liquid holding portion 64 which is positioned in the periphery of the discharge portion 31. Therefore, it is possible to suppress the waste liquid which is adhered to the area around the discharge portion 31 subsequently dribbling from the area around the discharge portion 31 and dirtying the inner portion of the liquid ejecting apparatus 11.

(2) In a case in which the waste liquid container 29 is mounted on the mounting unit 30, since the liquid guiding portion 65*b* comes into contact with the liquid holding portion 64 of the periphery of the discharge portion 31, the waste liquid which is held by the liquid holding portion 64 may be guided into the waste liquid container 29 by the liquid guiding portion 65*b*.

(3) The liquid guiding portion 65*b* is positioned below the discharge portion 31 in a case in which the liquid ejecting apparatus 11 is inverted and assumes a posture in which the liquid container 19 assumes a high position, for example. Therefore, even in a case in which the waste liquid dribbles from the discharge portion 31 due to the differential head, the waste liquid may be held by the liquid holding portion 64, and further, the waste liquid which is held by the liquid holding portion 64 may be guided into the waste liquid container 29 via the liquid guiding portion 65*b*.

(4) In a case in which the liquid container 19 assumes a posture at a high position, the apparatus-side terminal portion 33 is positioned above the discharge portion 31. Therefore, even in a case in which the waste liquid dribbles from the discharge portion 31 due to the differential head, it is possible to suppress the waste liquid getting into the apparatus-side terminal portion 33.

(5) The recessed portions 63 which exhibit the capillary phenomenon are provided on the bottom surface of the support member 60 which supports the downstream end of the waste liquid tube 24 which functions as the discharge portion 31 and the liquid holding portion 64 is configured by the recessed portions 63. Therefore, even if other members are not especially used, it is possible to provide the liquid holding portion 64 in the periphery of the discharge portion 31 and it is possible to reduce the apparatus cost.

(6) In order to configure the liquid holding portion 64 using the plurality of recessed portions 63, it is possible to increase the amount of the waste liquid which may be held by the liquid holding portion 64.

(7) Since the heights of the convex portions 62 which are adjacent to each other to interpose the recessed portions 63 therebetween are different, it is possible to suppress the waste liquid which adheres to the area around the discharge portion 31 from traveling between the distal ends of the plurality of convex portions 62 and spreading in a direction which distances from the discharge portion 31.

Furthermore, the embodiment described above may also be modified as in the modification examples described below. The configurations included in the embodiment may be combined with the configurations included in the modification examples in a predetermined manner and the configurations included in the modification examples may be combined with each other in a predetermined manner.

The convex portions 62 and the recessed portions 63 which configure the liquid holding portion 64 in the periphery of the discharge portion 31 may not be concentric circular ring-shaped convex portions 62 and recessed portions 63 which are centered on the discharge portion 31. Essentially, a configuration may be adopted in which the recessed portions 63 which exhibit the capillary phenomenon between one convex portion 62 and another convex portion 62 which are adjacent in a direction distancing from the discharge portion 31 and are capable of holding the waste liquid are formed in the periphery of the discharge portion 31.

Figure 8:
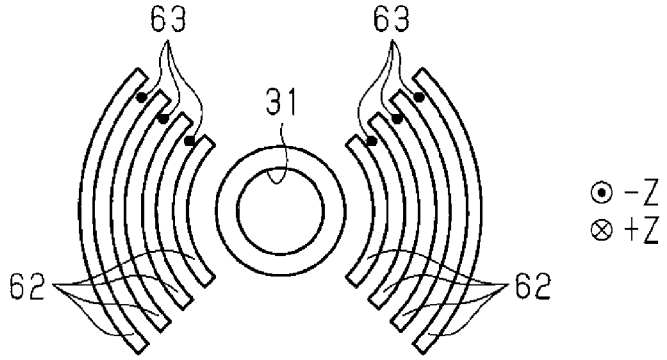
FIG. 8 is a diagram schematically illustrating a liquid holding portion of a first modification example.

For example, as in the first modification example illustrated in FIG. 8, for example, a configuration may be adopted in which a plurality of arc-shaped convex portions 62 which form an asymmetrical shape centered on the discharge portion 31 are lined up to leave a fixed interval to form groove-shape recessed portions 63 between each convex portion 62 and another adjacent convex portion 62 in one direction in a radial direction centered on the discharge portion 31. In this case, when the plurality of arc-shaped convex portions 62 which are adjacent in one direction are configured such that the lengths of the arcs are longer than those of the other convex portions 62 which are adjacent on the side closer to the discharge portion 31, the length increasing with the distance from the discharge portion 31, it is possible to increase the possible holding capacity of the waste liquid.

Figure 9:
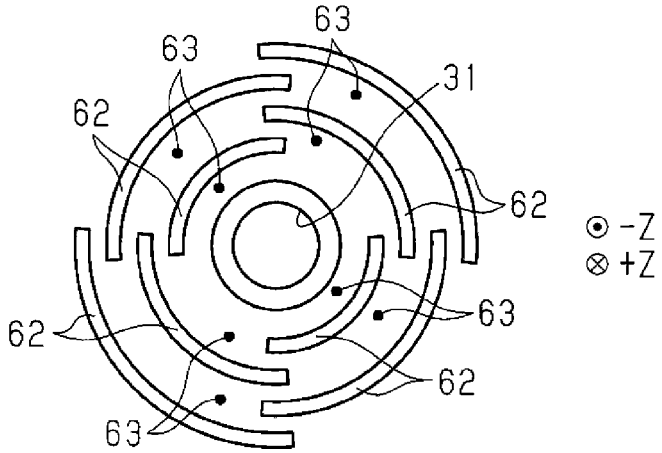
FIG. 9 is a diagram schematically illustrating a liquid holding portion of a second modification example.

For example, as in the second modification example illustrated in FIG. 9, for example, a configuration may be adopted in which a plurality of arc-shaped convex portions 62 which form an asymmetrical shape centered on the discharge portion 31 are lined up to leave a fixed interval to form groove-shape recessed portions 63 between each convex portion 62 and another adjacent convex portion 62 in two directions which intersect each other in the radial direction centered on the discharge portion 31. In this case, when one group of the convex portions 62 which are lined up leaving an interval in one direction in the radial direction and the other group of convex portions 62 which are lined up leaving an interval in another direction are disposed such that the end portions in the circumferential direction partially overlap each other in the radial direction centered on the discharge portion 31, it is possible to effectively suppress the waste liquid spreading in a direction which distances from the discharge portion 31.

Figure 10:
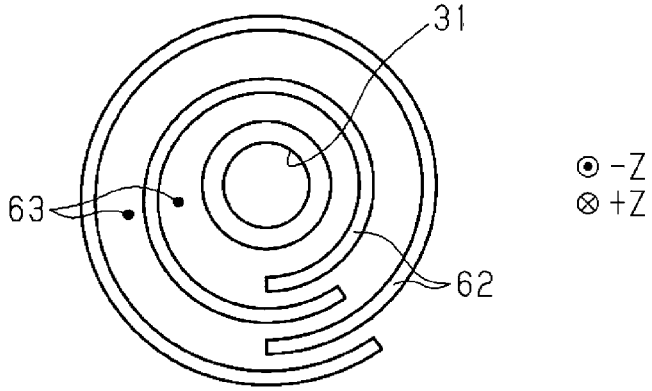
FIG. 10 is a diagram schematically illustrating a liquid holding portion of a third modification example.

For example, as in the third modification example illustrated in FIG. 10, a configuration may be adopted in which, on the outside of one convex portion 62 which forms a winding shape centered on the discharge portion 31, a convex portion 62 which forms a larger winding shape is provided such that a recessed portion 63 of a winding shape is formed between the larger convex portion 62 and the convex portion 62 of the inside winding shape. Even in this case, it is possible to suppress the spreading of the waste liquid in a direction distancing from the discharge portion 31 using the convex portions 62 which have winding shapes.

A configuration may be adopted in which, in the periphery of the discharge portion 31, the heights of the convex portions 62 which are adjacent to each other to interpose the recessed portion 63 therebetween are the same height, and in which the heights change alternately in the direction which distances from the discharge portion 31. Essentially, the configuration is not limited to one in which there are a plurality of convex portions 62 in the embodiment illustrated in FIG. 5.

A configuration may be adopted in which there is only one recessed portion 63 which is formed between the convex portion 62 and another convex portion 62 in the periphery of the discharge portion 31, and a configuration may be adopted in which the plurality of (other than three illustrated in the embodiment) recessed portions 63 are formed.

The groove-shaped recessed portion 63 which configures the liquid holding portion 64 in the periphery of the discharge portion 31 may be configured such that the groove width at a location which comes into contact with the liquid guiding portion **65*b* which protrudes from the waste liquid inlet portion 44 of the waste liquid container 29 is narrower than the groove width at the other locations. In a case in which such a configuration is adopted, since the capillary phenomenon in the recessed portion 63 becomes stronger at the location which comes into contact with the liquid guiding portion 65*b*, it is possible to actively guide the waste liquid from the liquid holding portion 64 to the liquid guiding portion 65*b***.

The recessed portions 63 which are provided in the periphery of the discharge portion 31 in order to configure the liquid holding portion 64 are not limited to the groove-shaped recessed portions 63, and may be recessed portions 63 which are configured as through-holes or holes which are formed in a plurality of locations in the periphery of the discharge portion 31.

In addition to being configured by the recessed portions 63, the liquid holding portion 64 may be configured to be capable of surrounding and holding the waste liquid which adheres to the periphery of the discharge portion 31 such as the liquid absorbing material, for example.

The waste liquid container 29 is not limited to a configuration in which the waste liquid container 29 is attachable and detachable with respect to the mounting unit 30 and may be configured to be fixed to the mounting unit 30. Essentially, the waste liquid container 29 may be capable of receiving the waste liquid discharged from the discharge portion 31 by the waste liquid inlet portion 44 in a state in which the waste liquid container 29 is fixed to the mounting unit 30.

In addition to being configured by a portion of the liquid absorbing material 65, the liquid guiding portion **65*b* which comes into contact with the liquid holding portion 64 and guides the waste liquid into the waste liquid container 29 may be configured by a brush body, a string body made of fibers, or the like which protrudes from the inside of the waste liquid container 29**.

The liquid guiding portion **65*b* may be configured to contact the entirety of the liquid holding portion 64 which is configured by the ring-shaped recessed portions 63**.

In a state in which the waste liquid container 29 is mounted on the mounting unit 30, the discharge portion 31 may be configured by being disposed in another position instead of between the liquid container 19 and the liquid guiding portion **65*b***.

The liquid guiding portion **65*b* may be disposed at a position other than under the discharge portion 31, for example, above the discharge portion 31 in a case in which the liquid ejecting apparatus 11** is inverted.

The liquid ejecting apparatus 11 may be a so-called line head type liquid ejecting apparatus in which the liquid ejecting head 14 is disposed in a fixed manner along the entire width of the transporting region of the paper P instead of a serial type liquid ejecting apparatus in which the liquid ejecting head 14 is mounted on the carriage 13 which moves reciprocally.

Hereinafter, a description will be given of the technical ideas to be ascertained from the embodiment and the modification examples and the operations and effects thereof.

Idea 1

A liquid ejecting apparatus includes a liquid ejecting head which ejects a liquid, a discharge portion which discharges a waste liquid discharged from the liquid ejecting head, and a mounting unit which is provided with the discharge portion and in which a waste liquid container capable of storing the waste liquid discharged from the discharge portion is mounted, in which the mounting unit includes a liquid holding portion capable of holding the waste liquid in a periphery of the discharge portion.

In this configuration, in a case in which the waste liquid discharged from the discharge portion of the mounting unit adheres to the area around the discharge portion without being discharged into the waste liquid container, the waste liquid is held by the liquid holding portion which is positioned in the periphery of the discharge portion. Therefore, it is possible to suppress the waste liquid which is adhered to the area around the discharge portion subsequently dribbling from the area around the discharge portion and dirtying the inside of the apparatus.

Idea 2

The liquid ejecting apparatus according to Idea 1, in which the waste liquid container is configured to be mounted to be attachable and detachable with respect to the mounting unit and includes a liquid guiding portion which comes into contact with at least a portion of the liquid holding portion in a state in which the waste liquid container is mounted on the mounting unit to guide the waste liquid into the waste liquid container.

In this configuration, in a case in which the waste liquid container is mounted on the mounting unit, since the liquid guiding portion comes into contact with the liquid holding portion of the periphery of the discharge portion, the waste liquid which is held by the liquid holding portion may be guided into the waste liquid container by the liquid guiding portion.

Idea 3

The liquid ejecting apparatus according to Idea 2, further includes a liquid container which stores the liquid to be supplied to the liquid ejecting head, in which in a state in which the waste liquid container is mounted on the mounting unit, the discharge portion is disposed between the liquid container and the liquid guiding portion.

In this configuration, the liquid guiding portion is positioned below the discharge portion in a case in which the liquid ejecting apparatus is inverted and assumes a posture in which the liquid container assumes a high position, for example. Therefore, even in a case in which the waste liquid dribbles from the discharge portion due to the differential head, the waste liquid may be held by the liquid holding portion, and further, the waste liquid which is held by the liquid holding portion may be guided into the waste liquid container via the liquid guiding portion.

Idea 4

The liquid ejecting apparatus according to Idea 3, in which the waste liquid container includes a container-side terminal portion, in which the mounting unit includes an apparatus-side terminal portion capable of being electrically connected to the container-side terminal portion, and in which the apparatus-side terminal portion is disposed between the liquid container and the discharge portion.

In this configuration, the apparatus-side terminal portion is positioned above the discharge portion in a case in which the liquid ejecting apparatus is inverted and assumes a posture in which the liquid container assumes a high position, for example. Therefore, even in a case in which the waste liquid dribbles from the discharge portion due to the differential head, it is possible to suppress the waste liquid getting into the apparatus-side terminal portion.

Idea 5

The liquid ejecting apparatus according to Idea 1 further includes a liquid container which stores the liquid to be supplied to the liquid ejecting head, in which the waste liquid container is configured to include a waste liquid inlet portion capable of introducing the waste liquid discharged from the discharge portion and a liquid guiding portion which protrudes from the waste liquid inlet portion and is capable of contacting the liquid holding portion and to be mounted to be attachable and detachable with respect to the mounting unit, and in which in a state in which the waste liquid container is mounted on the mounting unit, the discharge portion is disposed between the liquid container and the liquid guiding portion.

In this configuration, the liquid guiding portion is positioned below the discharge portion in a case in which the liquid ejecting apparatus is inverted and assumes a posture in which the liquid container assumes a high position, for example. Therefore, even in a case in which the waste liquid dribbles from the discharge portion due to the differential head, the waste liquid may be held by the liquid holding portion, and further, the waste liquid which is held by the liquid holding portion may be guided into the waste liquid container via the liquid guiding portion. As a result, it is possible to suppress the dirtying of the inside of the apparatus and it is possible to maintain the function of the liquid holding portion.

Idea 6

The liquid ejecting apparatus according to Idea 1 further includes a housing which stores at least the liquid ejecting head and the discharge portion, and a liquid container which stores the liquid to be supplied to the liquid ejecting head, in which the waste liquid container is configured to include a waste liquid inlet portion capable of introducing the waste liquid discharged from the discharge portion and a liquid guiding portion which protrudes from the waste liquid inlet portion and is capable of contacting the liquid holding portion and to be mounted to be attachable and detachable with respect to the mounting unit, and in which in a state in which the waste liquid container is mounted on the mounting unit, in a case in which the housing is inverted to a posture in which the liquid container is above the liquid ejecting head and the waste liquid container is below the liquid ejecting head, the liquid guiding portion is disposed to be positioned below the discharge portion.

In this configuration, in a case in which the housing is inverted to a posture in which the liquid container is above the liquid ejecting head and the waste liquid container is below the liquid ejecting head, the liquid guiding portion is positioned below the discharge portion. Therefore, even in a case in which the waste liquid dribbles from the discharge portion due to the differential head, the waste liquid may be held by the liquid holding portion, and further, the waste liquid which is held by the liquid holding portion may be guided into the waste liquid container via the liquid guiding portion. As a result, it is possible to suppress the dirtying of the inside of the apparatus and it is possible to maintain the function of the liquid holding portion.

Idea 7

The liquid ejecting apparatus according to any one of Ideas 1 to 6, in which the liquid holding portion is a recessed portion which is provided in a periphery of the discharge portion.

In this configuration, even if other members are not especially used for holding the waste liquid which adheres to the area around the discharge portion, it is possible to provide the liquid holding portion in the periphery of the discharge portion and it is possible to reduce the apparatus cost.

Idea 8

The liquid ejecting apparatus according to Idea 7, in which a plurality of the recessed portions are provided.

In this configuration, it is possible to increase the amount of the waste liquid which may be held by the liquid holding portion.

Idea 9

The liquid ejecting apparatus according to Idea 7 or Idea 8, in which the recessed portion is positioned between a plurality of convex portions which are provided in the periphery of the discharge portion and the plurality of convex portions have different heights from the convex portions which are adjacent in a direction distancing from the discharge portion.

In this configuration, it is possible to suppress the waste liquid which adheres to the area around the discharge portion from traveling between the distal ends of the plurality of convex portions and spreading in a direction which distances from the discharge portion.

The entire disclosure of Japanese Patent Application No. 2017-137076, filed Jul. 13, 2017 is expressly incorporated by reference herein.

What is claimed is:

1. A liquid ejecting apparatus comprising:

a liquid ejecting head which ejects a liquid;

a discharge portion which discharges a waste liquid discharged from the liquid ejecting head; and a mounting unit which is provided with the discharge portion and in which a waste liquid container capable of storing the waste liquid discharged from the discharge portion is mounted, wherein the mounting unit includes a liquid holding portion capable of holding the waste liquid in a periphery of the discharge portion, wherein the waste liquid container contains a liquid absorbable material, wherein the liquid absorbable material has a liquid guiding portion configured to guide the waste liquid into the waste liquid container, and wherein at least a portion of the liquid holding portion comes into contact with the liquid guiding portion in the state in which the waste liquid container is mounted on the mounting portion.

2. The liquid ejecting apparatus according to claim 1, wherein the liquid guiding portion extends from an inside of the waste liquid container toward the mounting unit.

3. The liquid ejecting apparatus according to claim 2, further comprising:

a liquid container which stores the liquid to be supplied to the liquid ejecting head, wherein in a state in which the waste liquid container is mounted on the mounting unit, the discharge portion is disposed between the liquid container and the liquid guiding portion in a horizontal direction.

4. The liquid ejecting apparatus according to claim 3, wherein the waste liquid container includes a container-side terminal portion, wherein the mounting unit includes an apparatus-side terminal portion capable of being electrically connected to the container-side terminal portion, and wherein the apparatus-side terminal portion is disposed between the liquid container and the discharge portion in the horizontal direction.

5. The liquid ejecting apparatus according to claim 1, further comprising:

a liquid container which stores the liquid to be supplied to the liquid ejecting head, wherein the waste liquid container is configured to include a waste liquid inlet portion capable of introducing the waste liquid discharged from the discharge portion and the liquid guiding portion which protrudes from the waste liquid inlet portion and to be mounted to be attachable and detachable with respect to the mounting unit, and wherein in a state in which the waste liquid container is mounted on the mounting unit, the discharge portion is disposed between the liquid container and the liquid guiding portion in the horizontal direction.

6. The liquid ejecting apparatus according to claim 1, further comprising:

a housing which stores at least the liquid ejecting head and the discharge portion; and a liquid container which stores the liquid to be supplied to the liquid ejecting head, wherein the waste liquid container is configured to include a waste liquid inlet portion capable of introducing the waste liquid discharged from the discharge portion and the liquid guiding portion which protrudes from the waste liquid inlet portion and to be mounted to be attachable and detachable with respect to the mounting unit, and wherein in a state in which the waste liquid container is mounted on the mounting unit, in a case in which the housing is inverted to a posture in which the liquid container is above the liquid ejecting head and the waste liquid container is below the liquid ejecting head, the discharge portion is disposed to be positioned above the liquid guiding portion.

7. The liquid ejecting apparatus according to claim 1, wherein the liquid holding portion includes an annular recessed portion.

8. The liquid ejecting apparatus according to claim 7, wherein the liquid holding portion includes a plurality of annular recessed portions.

9. The liquid ejecting apparatus according to claim 7, wherein the annular recessed portion is positioned between a plurality of annular convex portions which are provided in the periphery of the discharge portion and the plurality of annular convex portions have different heights.

10. The liquid ejecting apparatus according to claim 7, wherein at least a portion of the annular recessed portion comes into contact with the liquid guiding portion in the state in which the waste liquid container is mounted on the mounting portion.

11. The liquid ejecting apparatus according to claim 8, wherein at least a portion of the plurality of annular recessed portions come into contact with the liquid guiding portion in the state in which the waste liquid container is mounted on the mounting portion.

12. The liquid ejecting apparatus according to claim 1, wherein the liquid holding portion includes a recessed portion, wherein the recessed portion is positioned between a plurality of convex portions which are provided in the periphery of the discharge portion, wherein a height of one convex portion of the plurality of convex portions is lower than a height of another convex portion of the plurality of convex portion adjacent to the one convex portion in a direction distanced from the discharge portion.

13. The liquid ejecting apparatus according to claim 7, wherein the annular recessed portion is positioned between a plurality of annular convex portions which are provided in the periphery of the discharge portion, wherein a height of one convex portion of the plurality of convex portions is lower than a height of another convex portion of the plurality of convex portion adjacent to the one convex portion in a direction distanced from the discharge portion.

* * * * *